United States Patent [19]

Christ

[11] Patent Number: 4,637,333

[45] Date of Patent: Jan. 20, 1987

[54] SAIL HAVING A HONEYCOMB ARRAY OF POCKETS

[76] Inventor: Howard N. Christ, 291 Cedar Ave., Islip, N.Y. 11751

[21] Appl. No.: 806,560

[22] Filed: Dec. 9, 1985

[51] Int. Cl.[4] ..... B63H 9/06

[52] U.S. Cl. ..... 114/103; 244/145

[58] Field of Search ..... 114/102, 103; 244/145

[56] References Cited

U.S. PATENT DOCUMENTS

| | | | |
|---|---|---|---|
| 2,159,923 | 5/1939 | Willard | 114/103 |
| 2,730,316 | 1/1956 | Frieder et al. | 244/145 |
| 3,690,603 | 9/1972 | Lemoigne | 244/145 |
| 3,851,612 | 12/1974 | Jalbert | 114/103 |

FOREIGN PATENT DOCUMENTS

| | | | |
|---|---|---|---|
| 1303482 | 11/1962 | France | 114/103 |
| 2499503 | 8/1982 | France | 114/103 |

*Primary Examiner*—Galen L. Barefoot
*Assistant Examiner*—Stephen P. Avila
*Attorney, Agent, or Firm*—Edward H. Loveman

[57] ABSTRACT

A sail for a wind driven craft includes a panel having a multiplicity of pockets disposed in contiguous rows, and staggered with respect to pockets in adjacent rows, and aligned with pockets in alternate rows, to define a honeycomb array. Open ends of the pockets may be polygonal and have curved inner walls with closed ends. External sides of the pockets are convex. Each pocket has an infinite number of diametral planes dividing the pocket into two spaces of equal volume. The panel may have a peripheral flange overlapping peripheral pockets.

13 Claims, 22 Drawing Figures

SAIL HAVING A HONEYCOMB ARRAY OF POCKETS

BACKGROUND OF THE INVENTION

1. Field of the Invention

This invention relates to the art of sail construction, and more particularly concerns a sail having a multiplicity of adjoining pockets arranged in a honeycomb array to increase the effective wind catchment efficiency and to maximize stability of lift of the sail.

2. Description of the Prior Art

In U.S. Pat. No. 2,159,923 there is described a sail having a multiplicity of semi-ellipsoidal pockets. Each pocket is oriented on an axis disposed at an angle to the straight bottom foot of the sail. The pockets are spaced apart, with no pocket edges contiguous. Each pocket has a shallow lower end and deeper upper end. This arrangement of pockets is said to impart a lifting effect when driving wind impinges on the sail.

In U.S. Pat. No. 3,851,612 there is described a spinnaker, the lower portion of which has a plurality of rectangular pockets aligned horizontally and vertically. These pockets are scoop shaped with shallow inner ends disposed closer to the center vertical line of the sail and deeper outer ends disposed further from the center line of the sail. The pockets are said to serve aerodynamic lifting and stabilizing functions, and are also said to help keep the sail open to the wind.

The pockets in the prior sails cover only relatively small portions of the wind impingement area, so that they produce limited beneficial aerodynamic effects. The horizontal, vertical, or inclined orientation of the pockets produces destabilizing effects unless the wind impinges head on. Since the wind shifts constantly it rarely inpinges head on for more than a few moments at a time. At all other times the presence of the pockets causes destabilization effects regardless of the particular orientation of the axes of the pockets.

SUMMARY OF THE INVENTION

The present invention is directed at overcoming the difficulties, disadvantages and objections to the prior pocket sails. A principal object of the present invention is to increase the efficiency of wind catchment over that of a flat sail or prior pocket sails by a factor of four to eight times, thus driving a craft on which the present sail is mounted much faster and with greater lift and stability than is obtainable by means of a conventional sail with or without the prior pockets.

According to the invention, a flexible sail is provided with a panel having cup-shaped pockets disposed in a honeycomb array occupying substantially the entire useful wind impingement or catchment area of the sail. At one side, the sail has a multiplicity of polygonal openings formed into closed curved concavities in the pockets. On the other side of the sail the pockets present a multiplicity of convexities in honeycomb arrangement. Open ends of the pockets have edges contiguous with edges at open ends of adjacent pockets so that these open ends interfit to form the polygonal, honeycomb array. This structural arrangement presents a maximum wind catchment area for each pocket. The uniform pockets are effective in catching the wind regardless of whether it impinges on the sail, head on or obliquely, with substantially none of the destabilizing effects produced by prior sails equipped with pockets.

The panels may be made from a plurality of individual pockets sewn together at their edges. Each pocket may be fabricated from two flat blanks sewn together at one edge. Alternatively, the panels may be integrally molded from plastic material so that all pockets form a honeycomb unit. Such panels may have round or polygonal openings at one side of the panel, inner closed curved walls, and external convex sides at the other side of the panel.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENTS

Figure 1:
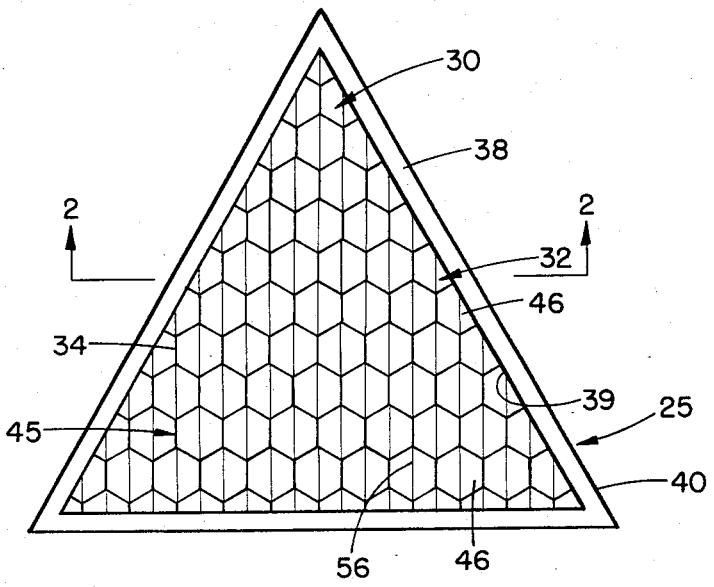
FIG. 1 is an elevational view of a multipocket sail embodying the present invention.
Figure 2:
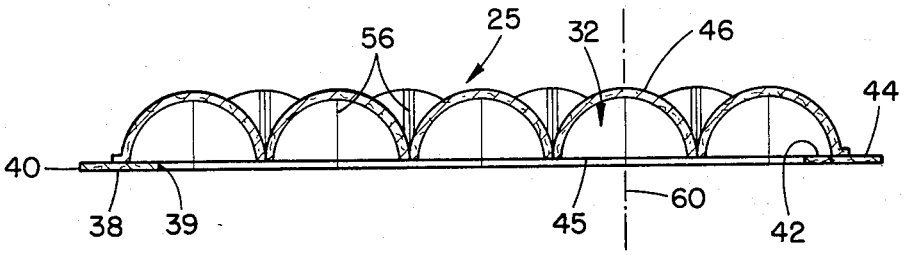
FIG. 2 is an enlarged cross sectional view taken along line 2—2 of FIG. 1.

Referring now to the drawings wherein like reference characters designate like or corresponding part throughout, there is illustrated in FIGS. 1 and 2, a sail generally designated as reference numeral 25 for a sailboat. The sail 25 has a flexible panel 30 made of a multiplicity of pockets 32 sewn together at their contiguous edges 34 to form a triangular honeycomb array; see FIG. 3. The pockets 32 are arranged contiguous to each other in parallel contiguous rows with the pockets 32 in adjacent rows staggered with respect to lines perpendicular to the rows. The pockets 32 in alternate rows are aligned with respect each other for the full length of the panel. At the periphery of the panel 30 is attached by stitching, rivets, cementing or other means a narrow strip 38. The periphery of the panel 30 is secured to the strip 38 midway between its inner and outer edges 39, 40. This form of attachment defines an inner narrow flange 42 overlapping the outer mouths of the outer pockets as best shown in FIG. 2. The outer flange 44 can be secured to a boat mast and boom or spar in a conventional fashion. The inner flange 42 serves to prevent or reduce loss of driving wind tending to flow around the outer periphery of the sail 25.

Figure 3:
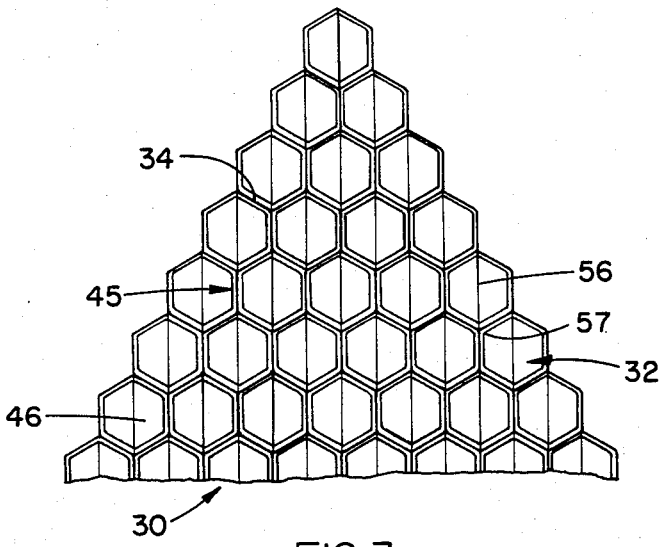
FIG. 3 is an enlarged elevational view of part of the multipocket panel of FIG. 1.
Figure 4:
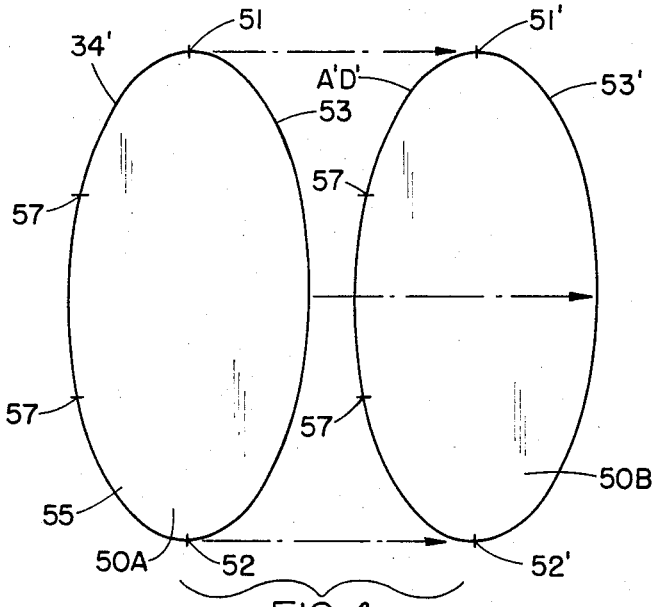
FIG. 4 is an enlarged plan view of two elliptical blanks used for making a pocket of a sail or sail panel such as shown in FIGS. 1, 2, and 3.
Figure 5:
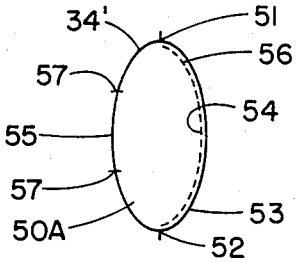
FIG. 5 is a reduced plan view showing the blanks of FIG. 4 sewn together to form a pocket.
Figure 6:
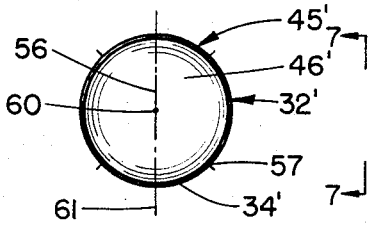
FIG. 6 is a front elevational view of the pocket of FIG. 5 in expanded position.
Figure 7:
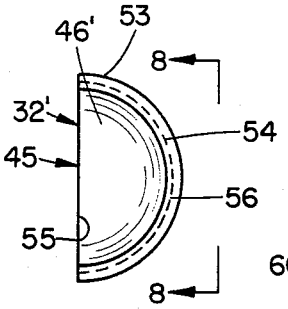
FIG. 7 is an enlarged side elevational view of the pocket FIG. 6.
Figure 8:
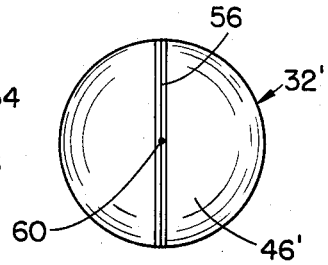
FIG. 8 is rear elevational taken along line 8—8 of the pocket of FIG. 7.
Figure 9:
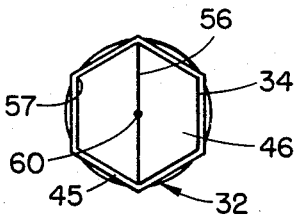
FIG. 9 is a front view similar to FIG. 6, but showing the open end of the pocket expanded to form a hexagonal mouth.
Figure 10:
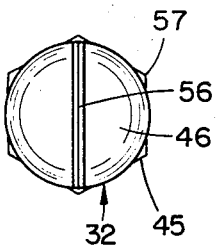
FIG. 10 is a rear elevational view of the pocket of FIG. 9.

It will be noted in FIGS. 1, 2, 3, that the pockets 32 generally have hexagonal mouths or open ends 45 with straight edges 34 while the inner curved pocket wells 46 are spherically curved. A preferred way in which this configuration may be obtained is explained with particular reference to FIGS. 4–8. A pair of identical, flat, flexible, elliptical blanks 50A, 50B made of sail cloth, canvas or other fabric is provided as shown in FIG. 4. The blanks 50A, 59B have opposite diametral points 51, 52 and 51', 52', and semi-elliptical edge portions 53, 53' between the points 51, 51', 52, 52'. The two blanks 50A, 50B may be superimposed on each other so that the elliptical edge portions 53, 53' of the two blanks are disposed in registration. Then the semi-elliptical edge portions 53, 53' may be sewn together by a semi-elliptical line of stitching 54 as shown in FIG. 5 to form a seam 56. The pocket 32' may now be expanded to the open form shown in FIGS. 6, 7 and 8. The free edge portions 55 will define a round or circular mouth 45' while the inner walls 46' of the pocket 32 are generally hemispherical. When six edge portions 34' of a multiplicity of these pockets 32 are secured together, with the edge portions 34' terminating at points 51, 52 and 57 spaced 60 degrees around a central axis 60, the open ends 45 of the pockets 32 assume a straight sided hexagonal configuration as shown in FIGS. 1, 2, 3 and 9. The concave walls 46 of each pocket 32 will remain substantially hemispherical as shown in FIGS. 2 and 10.

Figure 11:
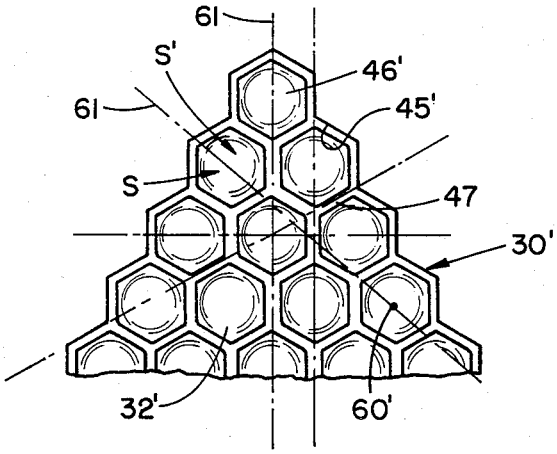
FIGS. 11 and 11A are elevational views of parts of other panels, similar to a portion of FIG. 3.

FIG. 11 shows a panel 30' resembling panel 30 of FIGS. 1 and 2. Here the flexible panel is molded as a single unit with all pockets 32' integrally joined together by a web 47 in a honeycomb array. The pockets 32' have open ends 45 formed with straight edges while the insides of the pockets may be hemispherical, ellipsoidal, paraboloidal, conoidal, prismoidal, or of other regular shape.

Figure 11A:
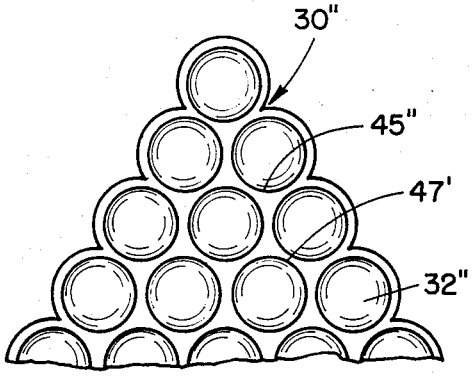

FIG. 11A shows a flexible panel 30'' having hemispherical or ellipsoidal pockets 32'' and round openings 45'' at one side of the panel. The pockets are integrally joined by a web 47' in a honeycomb array.

All of the panels 30, 30' and 30'' have pockets so shaped and arranged that an infinite number of diametral planes 61 may be regarded as passing through the central axis 60 of each pocket; see FIG. 11. The axis 60 extends perpendicular to the plane of the front side of the panel 30. Each diametral plane 61 bisects each pocket 32 to define two spaces S, S' of equal volume. This is a very important feature of the invention, because it insures that regardless of the direction of wind impinging at the open ends of the pockets 32 the resultants of forces will lie on some diametral planes 61 so that maximum driving and lifting force is applied even though the wind constantly shifts in direction from moment to moment. This contrasts with the prior pocket sails, such as described in the patents above mentioned. The semi-pear shaped pockets of U.S. Pat. No. 2,159,293 are symmetrically divided only by single diametral planes including the long axes of the pockets and disposed perpendicular to the plane of the sail. The scoop shaped pockets of U.S. Pat. No. 3,851,612 are symmetrical only on single horizontal planes disposed midway between the flat sides of the pockets perpendicular to the plane of the sail. Thus, wind shifting to any oblique direction destabilizes the sail and the craft it is driving.

In the present invention even though the wind shifts from one plane to another, driving efficiency of the wind remains substantially constant while stability of the sail and craft is maintained due to the symmetry of the pockets in an infinite number of planes. In the prior pocket sails driving efficiency of the wind can never be maximum because the wind shifts constantly. Also, forces constantly applied by the wind in planes oblique to the single planes of symmetry of the pockets tend to destabilize the sails. As abovementioned, these are important reasons why prior pocket sails have not been found practical in actual usage. The present invention avoids these objections in a simple and effective manner to result in improved wind driving eficiency and greater sail stability.

Figure 12:
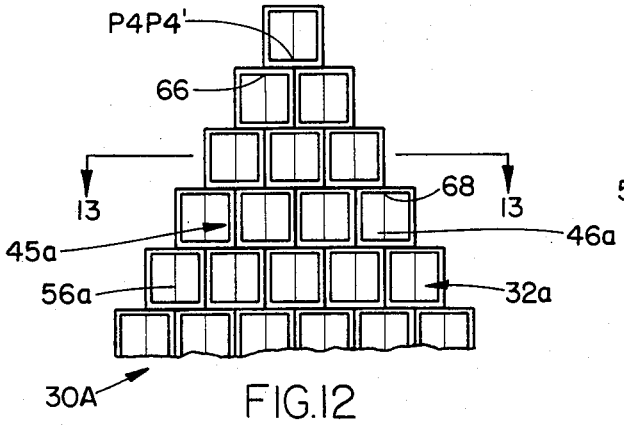
FIG. 12 is an elevational view of part of another multipocket panel having rectangular open ends.
Figure 14:
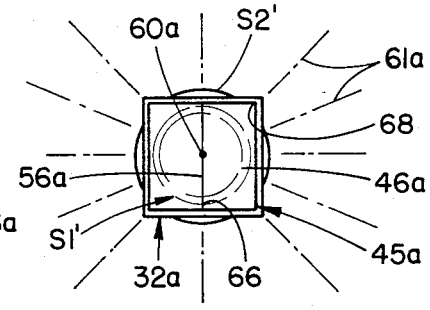
FIG. 14 is a front view of a single pocket of the panel of FIG. 12, showing multiple axes of symmetry.
Figure 13:
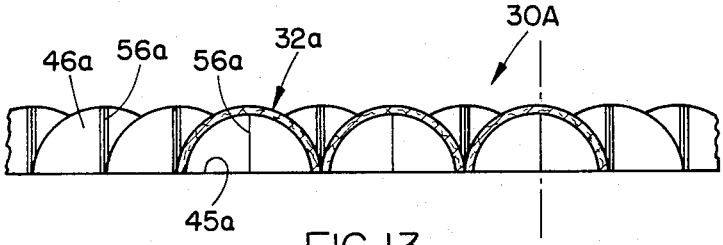
FIG. 13 is an enlarged cross sectional view taken along line 13—13 of FIG. 12.
Figure 15:
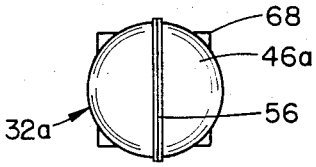
FIG. 15 is a rear elevational view of the pocket of FIG. 14.
Figure 16:
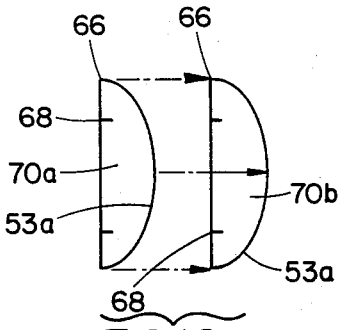
FIG. 16 is a plan view of two semi-elliptical blanks used for forming the pocket of FIGS. 14, 15.
Figure 17:
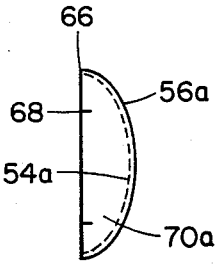
FIG. 17 is a plan view of the pocket made from the blanks of FIG. 16, shown in collapsed position.

FIGS. 12 and 13 show a honeycomb array of pockets 32 in a sail panel 30A wherein the pockets have retangular or square open ends **45*a*. The walls 46*a* of the pockets are substantially semispherical as best shown in FIGS. 13 and 15. Each pocket 32*a* may be made by a method similar to that explained above in connection with FIGS. 4–8. Here the flat blanks 70*a*, 70*b* shown in FIG. 16 may be semi-elliptical, Curved side portions 53*a* are superimposed and sewn together by a semielliptical line of stitching 54*a*, as shown in FIG. 17, forming seams 56*a*. The pockets 32*a* may open to define rectangular open ends 45*a* with end points 66 located at centers of top and bottom straight edges of the rectangular openings. Intermediate points 68 will be located at corners of the rectangular opening 45*a*; see FIGS. 12 and 14. The walls 46*a* of the pockets 32*a* assume semispherical shapes when the pockets are expanded and attached to each other at the rectangular mouths of the pockets. FIG. 14 shows that all diametral planes 61*a* include the central axis 60*a* of each pocket disposed perpendicular to the plane of the rectangular openings 45*a*. Each diametral plane 61 divides the pocket into two spaces 51' and 52'** of equal volume. Here again, as explained above, maximum driving efficiency is obtained while destabilizing forces are minimized, as the wind shifts in resultant direction from diametral plane to plane.

Figure 18:
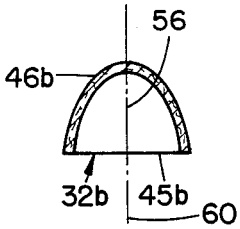
FIG. 18 and FIG. 19 are diametral cross sectional views of two further forms of pockets.
Figure 19:
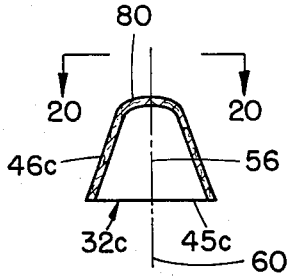
Figure 20:
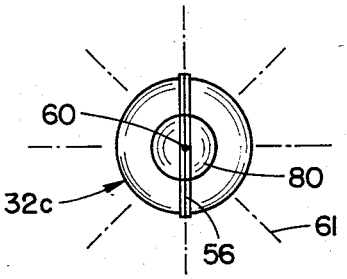
FIG. 20 is a rear elevational view taken along line 20—20 of FIG. 19.
Figure 21:
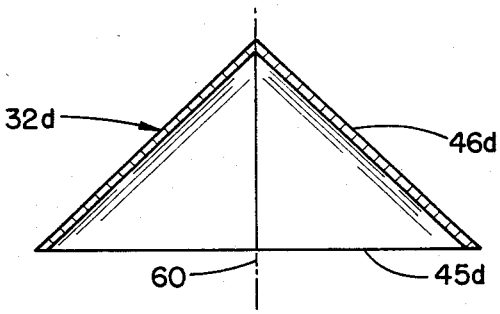
FIG. 21 is a diametral sectional view of a conical form of pocket.

FIG. 18 shows another form of a pocket **32*b* in which walls 46*b* define a semi-ellipsoid or semi-paraboloid. In FIGS. 19 and 20 walls 46*c* of a pocket 32*c* define generally, a frustum of a cone, shaped with a spherically curved closed rear end 80. In FIG. 21 a pocket 32*d* has a conical wall 46*d*. Open ends 45*b*, 45*c*, and 45*d* of the expanded pockets shown in FIGS. 18–21 may be shaped to any desired polygonal shape when many pockets are secured together at their open ends to form a honeycomb array. FIG. 20 shows that all pockets 32*b* and 32*c* and 32*d* are symmetrical on all diametral planes 61 including the central axis 60** of each pocket.

In all panels described above, the honeycomb array of pockets is a critical and crucial feature of the invention. Pockets in adjacent contiguous rows are staggered with respect to parallel lines perpendicular to the rows. All adjacent pockets in each row are contiguous. Pockets in alternate rows are aligned on lines perpendicular to the direction of the rows. There is substantially no wasted space between the pockets as occurs in some prior pocket sails. Thus, maximum driving and stabilizing effects are obtained from the honeycomb array. Although all the honeycomb arrays in FIGS. 1,3, 11, 11A, are illustrated as triangular and taper from a wise bottom foot to a narrow apex, it will be understood that the honeycomb array may be rectangular, square, trapezoidal, hexagonal, round, etc.,or other geometrical shape depending on the type of sail desired.

The several pockets of FIGS. 1–10, 12–21 have been shown and described as made of pairs of fabric blanks. It will be understood that the pockets may be molded from flexible plastic material as single units; and an entire panel may be molded with a multiplicity of pockets as a single integral unit as shown by panels 30', 30'' in FIGS. 11, 11A. Conventional processes may be used to mass produce the honeycomb pocket panels very economically.

It should be understood that the foregoing relates to only a limited number of preferred embodiments of the invention which have been by way of example only and that it is intended to cover all changes and modifications of the examples of the invention herein chosen for the purpose of the disclosure which do not constitute departures from the spirit and scope of the invention.

What is claimed is:

1. A sail for driving a wind driven craft, comprising:

a panel having a multiplicity of pockets disposed in a honeycomb array;

said pockets having open ends at one side of said panel, inner concave closed ends, and external convexities at the opposite side of said panel;

said open end of each of said pockets having edges contiguous with edges of open ends of other of said pockets;

each of said pockets having a central axis disposed perpendicularly to said open side of said panel;

each of said pockets having an infinite number of diametral planes including said central axis oriented perpendicular to said oen side of said panel and bisecting said pockets to define two spaces of equal volume; so that the wind drives said craft with maximum efficiency and minimum destabilzing effects when impinging in shifting directions on said one side of said panel; and flange means at peripheral edges of said honeycomb array overlaying said pockets at said peripheral edges to restrict flow of air between opposite side of said panel; and wherein said pockets are disposed in parallel rows, with pockets in adjacent rows offset from each other, and with pockets in alternate rows disposed in alignment perpendicular to said rows, so that said pockets define said honeycomb array in said panel.

2. A sail as defined in claim 1, wherein said open ends of said pockets are polygonal so that said edges of each pocket interfit with said edges of adjacent pockets.

3. A sail as defined in claim 1, wherein said closed ends of said panel are curved.

4. A sail as defined in claim 1, wherein said closed ends of said panel have geometric curvatures selected from the group consisting of spheroids, ellipsoids, paraboloids, prismoids and conoids.

5. A sail as defined in claim 1, wherein said closed ends of said pockets are curved, and wherein said open ends of said pockets are polygonal so that edges of each pocket interfit with said edges of adjacent pockets.

6. A sail as defined in claim 5, wherein said open ends of said pockets are hexagonal.

7. A sail as defined in claim 5, wherein said open ends of said pockets are rectangular.

8. A sail as defined in claim 1, wherein said panel is triangular.

9. A panel as defined in claim 1, wherein each of said pockets is formed by two flat flexible members having curved edge portions secured together.

10. A sail as defined in claim 9, wherein said flat members are elliptically curved so that said pockets are substantially circular in interior cross section when opened.

11. A sail as defined in claim 1, wherein said panel is formed as an integral unit with edges of said pockets joined by an integral web.

12. A sail as defined in claim 11, wherein said pockets have polygonal openings at said one side of said panel.

13. A sail as defined in claim 11, wherein said pockets have curved openings at said one side of said panel.

* * * * *

UNITED STATES PATENT AND TRADEMARK OFFICE

CERTIFICATE OF CORRECTION

PATENT NO. : 4,637,333

DATED : January 20, 1987

INVENTOR(S) : HOWARD N. CHRIST

It is certified that error appears in the above-identified patent and that said Letters Patent are hereby corrected as shown below:

IN THE SPECIFICATION:

Column 1, line 11 "of" (first occurence), should read---and---.

Column 5, line 10 "wise", should read---wide---.

IN THE CLAIMS:

Claim 1, line 45, "oen", should read---open---.

Signed and Sealed this

Twenty-seventh Day of October, 1987

*Attest:*

DONALD J. QUIGG

*Attesting Officer*

*Commissioner of Patents and Trademarks*